US005758463A

United States Patent [19]

Mancini, Jr.

[11] Patent Number: 5,758,463

[45] Date of Patent: Jun. 2, 1998

[54] COMPOSITE MODULAR BUILDING PANEL

[75] Inventor: Philip S. Mancini, Jr., Cranston, R.I.

[73] Assignee: P & M Manufacturing Co., Ltd., Providence, R.I.

[21] Appl. No.: 31,202

[22] Filed: Mar. 12, 1993

[51] Int. Cl.[6] ..... E04C 2/04

[52] U.S. Cl. ..... 52/309.12; 52/742.14; 52/602; 52/481.1; 52/309.7

[58] Field of Search ..... 52/309.4, 309.7, 52/309.9, 309.12, 309.16, 309.17, 479, 481.1, 481.2, 483.2, 489.1, 490, 577, 281, 282.1, 601, 602, 742.1, 742.14

[56] References Cited

U.S. PATENT DOCUMENTS

| | | | |
|---|---|---|---|
| 1,073,906 | 9/1913 | Kahn | 52/577 |
| 1,530,662 | 3/1925 | Gibbons et al. | 52/742.1 |
| 2,126,301 | 8/1938 | Wolcott | 52/577 |
| 2,934,934 | 5/1960 | Berliner | 52/309.17 |
| 3,388,509 | 6/1968 | Mora | 52/577 |
| 3,484,999 | 12/1969 | Van Der Lely | 52/601 X |
| 3,604,124 | 9/1971 | Nelson, Jr. | 52/601 X |
| 3,775,240 | 11/1973 | Harvey | 52/309.17 |
| 4,053,677 | 10/1977 | Corao | 52/309.12 |
| 4,154,042 | 5/1979 | Epes | 52/309.9 |
| 4,161,087 | 7/1979 | Levesque | 52/242 |
| 4,185,437 | 1/1980 | Robinson | 52/601 |
| 4,223,502 | 9/1980 | Robinson | 52/602 X |
| 4,395,457 | 7/1983 | Wyner | 428/312.4 |
| 4,426,061 | 1/1984 | Taggart | 52/309.12 |
| 4,489,530 | 12/1984 | Chang | 52/309.12 |
| 4,554,124 | 11/1985 | Sudrabin | 52/309.12 |

(List continued on next page.)

| | | |
|---|---|---|
| 4,602,467 | 7/1986 | Schilger . |

FOREIGN PATENT DOCUMENTS

| | | | |
|---|---|---|---|
| 0 381 000 | 8/1990 | European Pat. Off. . | |
| 0 392 610 | 10/1990 | European Pat. Off. . | |
| 1 587 550 | 3/1970 | France . | |
| 2583089 | 12/1986 | France | 52/309.9 |

OTHER PUBLICATIONS

Hugh R. Wilson "Gas Concrete Process . . . Solves Low Cost Basic Shelter Problem", printed from Florida Contractor and Builder.

Robert E. Lacey, "Sculptured Architecture From Spraying Vin Lox", Sep. 27, 1968, Dodge Construction News.

Hugh R. Wilson, "Concrete Without Forms . . . Moves Into Residential Field", Florida Contractor and Builder.

Beth Israel Synagogue Revolutionary Architectural Design "Spectacular, New Approach Uses Vin-Lox Gas Concrete System", printed from the Florida Contractor and Builder.

"Vin-Lox Spray-on Gas Concrete . . . Gives Architect Free Rein in Concrete Design", printed from the Florida Contractor and Builder.

*Primary Examiner*—Carl D. Friedman
*Assistant Examiner*—Winnie S. Yip
*Attorney, Agent, or Firm*—Reid & Priest L.L.P.

[57] ABSTRACT

A modular building panel comprising a single, monolithic, planar slab having a thickness and parallel inner and outer surfaces, the slab being formed primarily of cellular concrete and a pair of parallel linear members. Each of the linear members has outer and inner opposed parallel edges, a web connecting the edges, and an outer flange at the outer edge extending substantially perpendicular to the web. The slab extends between the webs of the outer side linear members, the outer edges and the outer flanges being embedded in the slab inwardly of its inner surface, and the outer surface of the slab being uninterrupted. The panel can additionally include at least one inner linear member intermediate and parallel to the outer side linear members. The outer edge, the outer flange, and at least part of the web of the at least one inner linear member are also embedded in the slab inwardly of its inner surface, and the inner surface of the slab is interrupted by the at least one linear member extending outwardly thereof. An insulation panel is positioned against the inner surface of the slab between pairs of adjacent linear members and is dimensioned to cover the inner surface of the slab between the pair of linear members.

18 Claims, 2 Drawing Sheets

U.S. PATENT DOCUMENTS

| | | | |
|---|---|---|---|
| 4,633,634 | 1/1987 | Nemmer et al. | 52/601 X |
| 4,649,682 | 3/1987 | Barrett, Jr. | 52/601 X |
| 4,738,067 | 4/1988 | Froseth | 52/483.1 |
| 4,856,244 | 8/1989 | Clapp | 52/309.12 |
| 4,941,304 | 7/1990 | Lewellin | 52/580 |
| 5,033,248 | 7/1991 | Phillips | 52/742.14 |
| 5,055,252 | 10/1991 | Zimmerman | 52/309.12 |
| 5,094,052 | 3/1992 | Gudmundsson et al. | 52/481.1 |
| 5,222,338 | 6/1993 | Hull et al. | 52/602 X |

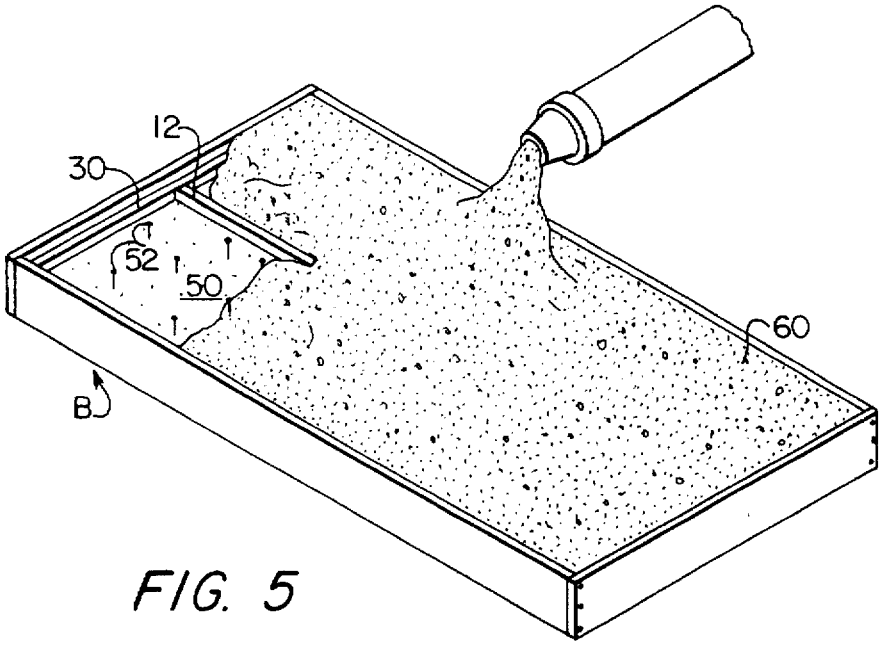
FIG. 5
FIG. 6
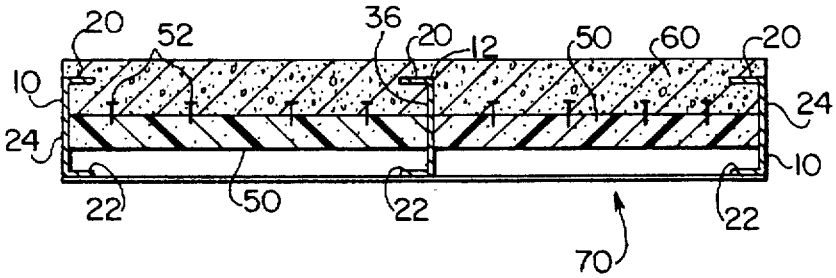

COMPOSITE MODULAR BUILDING PANEL

BACKGROUND OF THE INVENTION

1. Field of the Invention

This invention relates to a modular building panel for constructing buildings and enclosures, and a method for making such a modular building panel. More particularly, the invention relates to a composite modular panel employing adjacent cellular concrete and insulation panels positioned between parallel support studs.

2. Related Art

Prior concrete wall structures suffer from numerous defects including poor strength characteristics, higher construction costs, longer construction time, poor durability, and poor thermal and fire-resistant characteristics. Additionally, most current construction techniques are not resistant to extreme natural conditions such as hurricane winds or earthquakes.

For example, U.S. Pat. No. 5,055,252, to Zimmerman discloses a method of constructing a wall by casting concrete within a horizontal frame surrounding U-shaped stud forms to define the vertical studs, and support members which define the top and bottom horizontal members. Prior to filling the frame with concrete, 1) the spaces between the stud forms and the support members are filled with insulating panels supported on the edges of the stud molds, and 2) reinforcing rods are placed in the stud molds and support members, and the reinforcing rods are connected together to form an integrated reinforcing structure.

Although this process provides a satisfactory wall, the resulting wall is neither pre-fabricated nor modular, in the sense that it must be erected in situ, and cannot be manufactured off-site and transported to the site where it is assembled with like modules to construct a building. Further, the studs and beams of the panel are steel-reinforced concrete. Consequently, the panel lacks the strength of panels with steel studs and beams.

U.S. Pat. No. 4,856,244, to Clapp discloses a tilt-wall concrete panel with a peripheral frame of wood or wood-like members atop a barrier film of plastic, and an insulating foamed plastic cover poured as a liquid into the frame. Because Clapp does not use steel reinforcing, load-bearing members to support the concrete layer, the strength of his panel is reduced. Additionally, the structural integrity of the panel is reduced due to the absence of any means of bonding the concrete layer to either the foam layer or the "wood-like" studs. Finally, because the concrete must be poured on-site, the panel cannot be prefabricated.

U.S. Pat. No. 4,554,124, to Sudrabin discloses a construction panel comprising an outer molded panel contoured to provide openings such as windows and doors, a framework of C-shaped contour secured to the panel, window framing, and braces or studs extending horizontally across the framework. Sheet insulation can be positioned against the back (inner) surface of the panel. Wire mesh is suspended above the back surface, and concrete is introduced into the space within the frame beneath the top thereof. The concrete is poured flush with the upper flanges of the studs in the framework, and does not completely embed the braces and studs. One or more sheets of drywall can be secured to the surface of the concrete.

Because Sudrabin's panel is intended to comprise an entire wall, and may be used for multistory buildings, its size makes it unsuitable for use as a prefabricated module. Heavy lifting and moving equipment would be required both at the factory and on-site, and transportation of such large structures in urban areas would be exceedingly difficult.

U.S. Pat. No. 4,426,061, to Taggart discloses a method and apparatus for forming insulated walls. The wall includes an insulation module comprising a styrofoam insulation panel, a reinforcing mesh panel adjacent to the surface of the styrofoam insulation panel, and a U-shaped metal cap disposed on each side of the styrofoam insulation panel. The insulation modules are positioned upright in a U-shaped panel. Concrete is then poured into a form defined by the modules and a form panel parallel to an offset from the modules.

In the Taggart method, the concrete layer is poured in situ into a cavity formed by the insulation modules and a form panel. This method is not suitable for the production of modular, prefabricated panel which can be manufactured under factory conditions and shipped to a construction site for use.

U.S. Pat. No. 4,053,677, to Corao discloses a monolithic slab comprising an insulating, light concrete layer positioned between two exterior layers of reinforced concrete. The reinforced exterior layers are a mixture of sand and portland cement, water, and a synthetic emulsified resin. Glass fiber can be interspersed in the exterior layers. The intermediate, light layer is a mixture of particles of plastic material, water, synthetic resin, and concrete.

Corao's slab lacks studs or beams to reinforce the intermediate layer of concrete and resin. Similarly, the layers of concrete are bound together only by an undisclosed "inbetween" layer or film; no structural means extends through multiple layers of the slab to reinforce it. Finally, Corao does not provide for any insulation.

U.S. Pat. No. 2,934,934, to Berliner, discloses a construction panel comprising a corrugated metal sheet embedded in and protruding from the ends of a block of very lightweight cementitious material. The outer faces of the block are covered with a hard cement or concrete layer. There is no provision for insulation, nor does the structure lend itself to the addition of insulation. The complete absence of insulation renders the Berliner panel a poor choice for energy efficient constructions.

U.S. Pat. No. 2,126,301, to Wolcott, discloses a concrete slab structure comprising a plurality of parallel, spaced-apart concrete channel members embedded in a concrete slab. Metal reinforcing bars are arranged longitudinally in the spaces between the channel members, and a reinforcing fabric is laid over the bars. There is no provision for insulation, per se. Although some insulation effect may be exhibited by the void channels within the slab, the strength of the slab declines in direct proportion to increases in the width of the channels and the insulating effect obtained.

Steel-reinforced foamed concrete has also been used by Vin-Lox Corporation of Florida to create unique building structures. The Vin-Lox process involves spraying foamed concrete on wire mesh, which permits the creation of unusual designs. It is, however, inherently site-specific; economies of scale achievable under factory conditions are not possible with the process.

It is the solution of these and other problems to which the present invention is directed.

SUMMARY OF THE INVENTION

It is therefore a primary object of the invention to provide a building panel which is modular, while at the same time being strong and relatively lightweight, and a method of constructing such a building panel.

It is another object of the invention to provide a modular building panel which can be constructed in accordance with a simple method, and which is inexpensive to construct.

It is still another object of the invention to provide a modular building panel which can be constructed in factory conditions and shipped to the site of construction, facilitating both greater control of the manufacturing process, and faster construction of the building structure.

It is still another object of the invention to provide a modular building panel which, when assembled with like modular building panels, results in a monolithic structure which is resistant to earthquakes and hurricanes.

It is yet another object of the invention to provide a modular building panel which is constructed of materials which render it extremely fire-resistant.

These and other objects of the invention are achieved by the provision of a modular building panel comprising a composite slab having a generally rectangular shape held rigid within a steel stud framework. The slab includes an insulation layer comprising a panel of fiberglass or other fire-resistant material, and a concrete layer comprising a panel of foamed concrete formed by spraying or foaming cellular concrete over the insulation layer between and above the steel stud framework. The steel studs which comprise the framework include inwardly-facing flanges which are embedded in the concrete, thereby holding the concrete layer in place in the steel stud framework.

In its most basic embodiment, the modular panel employs two parallel, spaced-apart steel studs. Preferably, however, three parallel, spaced-apart steel studs are employed, with an insulation panel placed between adjacent pairs of studs, and with a single concrete layer formed over the two insulation panels and all three studs.

The steel studs form the sides of a rectangular frame for the panel, while steel beams form the top and bottom of the frame. The studs and beams preferably are channel-shaped, i.e. they have a lengthwise web having lengthwise flanges extending perpendicularly from either edge. During the fabrication process, the frame is placed on a supporting surface, and the insulation panels are spaced above the bottom edges or flanges of the steel to form the bottom side of the slab; and the foamed concrete forms the top or upper side. The terms "bottom side" and "insulation side" relate to the side of the panel having the insulation panels and are used interchangeably, as are the terms "top side", "upper side", and "concrete side", which relate to the side of the panel having the concrete layer. The layer of foamed concrete extends upwardly of the frame coplanar with the outer edges of the studs and beams, so that the upper flanges of the studs and beams are embedded in the concrete layer. In order to permit the concrete layer to be foamed or sprayed above the upper flanges of the studs and beams, a bulkhead framework is provided around and extending above the periphery of the stud and beam frame. The concrete layer thus, along with the peripheral studs and beams, comprises the edges of the building panel. In use, the concrete side of the building panel is disposed toward the exterior of the building, and the insulation side is disposed toward the interior of the building.

To reduce the weight of the concrete layer, and to provide better thermal properties, a foamed concrete is used for the concrete layer. The concrete layer can be textured or embossed in various decorative styles, for example to provide the appearance of brick in the exterior surface of the building.

As previously indicated, the panel preferably uses three parallel, spaced-apart, channel-shaped studs which provide upright support for the panel, and two channel-shaped beams at the ends of the studs which provide the widthwise support for the panel, the two outermost studs and the beams defining the rectangular shape of the panel. The third stud preferably is disposed midway between the two outermost studs. To provide rigidity to the frame, the studs are secured at each end to the beams by welding.

When assembly of the frame is completed, the insulation panels are inserted, the panels being sized to fit to a close tolerance between the webs of the studs and beams. The bulkhead framework is then placed around the periphery of the steel frame. The bulkhead framework is of a uniform height greater than the height of the steel frame to allow the concrete layer to extend above the upper flanges of the studs and beams. Foamed concrete is then sprayed or foamed into the steel frame over the insulation panels, covering the flanges of the studs and bases.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 5 illustrates the bulkhead framework constructed around the frame of the modular building panel of FIG. 1, and the spraying of the foamed concrete over the insulation panels within the bulkhead framework; and FIG. 6 is a cross-sectional view taken along line 6—6 of FIG. 1.

DETAILED DESCRIPTION OF THE PREFERRED EMBODIMENTS

Figure 1:
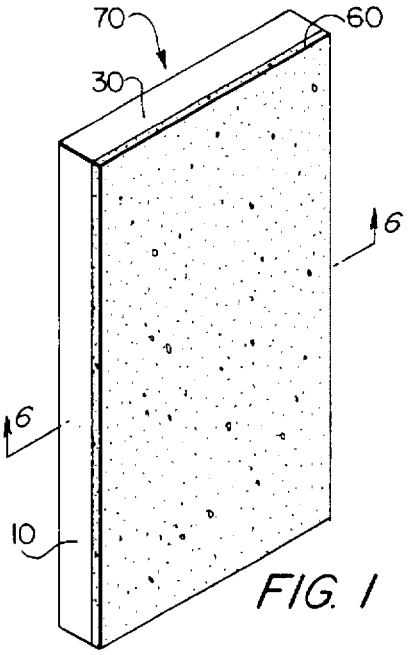
FIG. 1 is a front perspective view of the composite modular building panel in accordance with the present invention.
Figure 2:
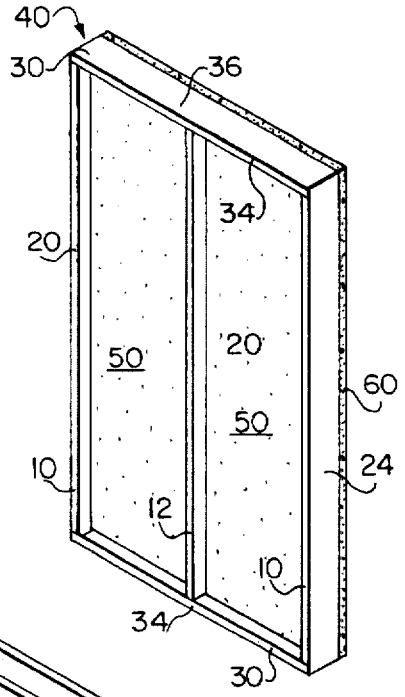
FIG. 2 is a rear perspective view of the composite modular building panel of FIG. 1.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 3:
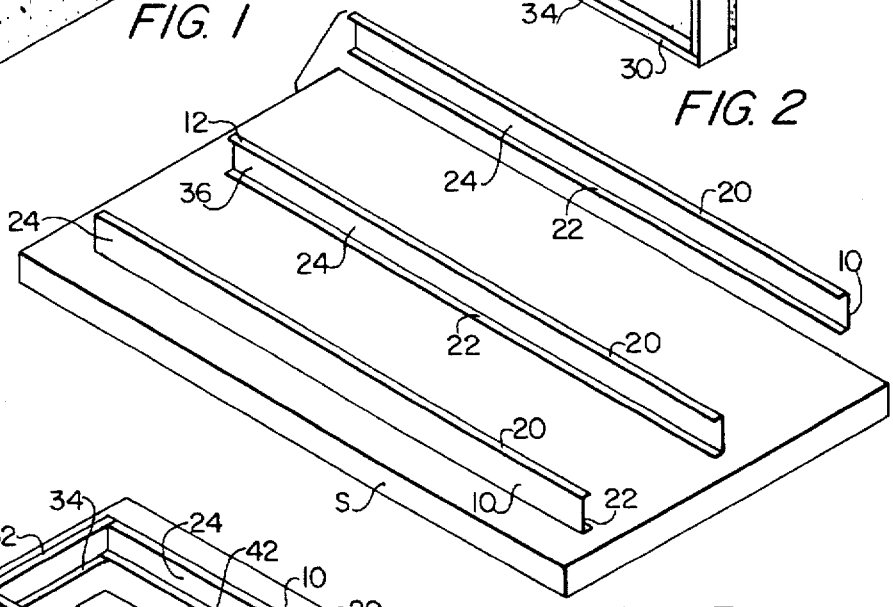
FIG. 3 is a perspective view illustrating the alignment of the studs preparatory to assembling of the frame of the modular building panel of FIG. 1.
Figure 4:
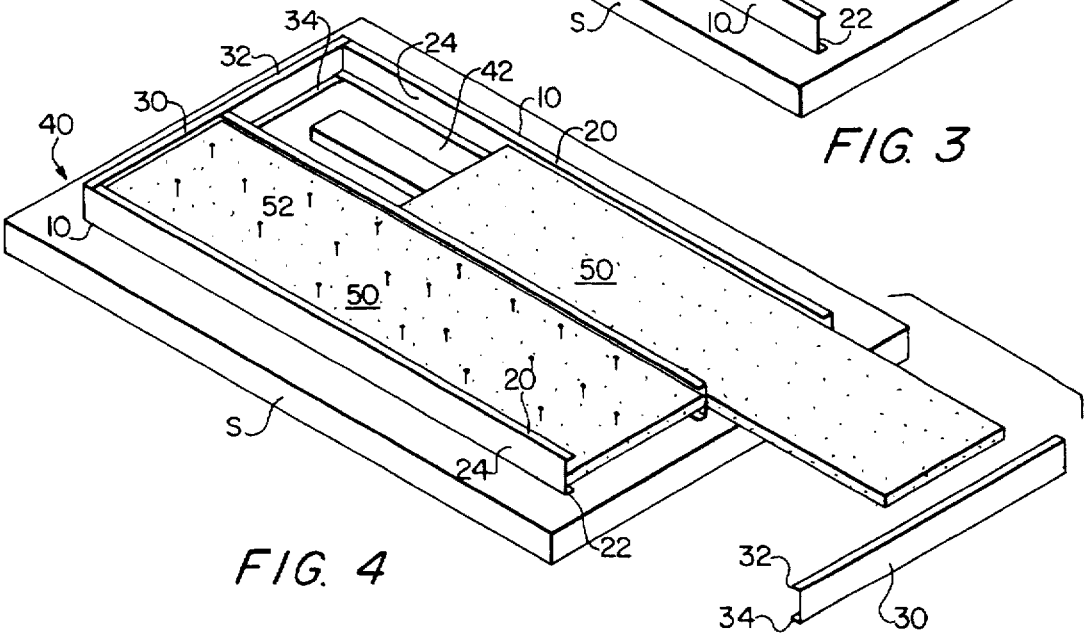
FIG. 4 is a perspective view illustrating the insertion of the insulation panels and the assembly of the frame of the modular building panel of FIG. 1.

Attention is initially directed to FIGS. 3 and 4, illustrating two outer channel-shaped studs 10 and an inner channel-shaped stud 12. Studs 10 and 12 are positioned on a support surface S, which must be level, and can be either a floor or, as preferred, a raised surface such as a platform or a table. As oriented on support surface S, studs 10 and 12 each have an upper or concrete-side flange 20, a lower or insulation-side flange 22, and a web 24 extending between upper flange 20 and lower flange 22. The flanges 20 and 22 of outermost studs 10 must be directed inwardly towards each other, while the flanges 20 and 22 of inner stud 12 must be directed towards one or the other of outermost studs 10.

Studs 10 and 12 preferably are disposed with their webs two feet apart, so that the distance between the outer surfaces of outermost studs 10 is four feet, the preferred width of the completed modular building panel. However, greater or lesser separation distances between studs 10 and 12 can be substituted without departing from the scope and spirit of the invention. It should be noted, however, that increasing separation distance between studs 10 and 12 decreases the structural strength of the resulting building panel. Further, additional inner studs 12 can be inserted at two foot or other intervals to create a building panel that is, for example, six feet or eight feet in width. When additional inner studs 12 are inserted, their flanges should also be directed towards one of the outermost studs 10.

Additional structural strength is provided by beams 30. Beams 30 are also channel-shaped, each beam 30 having an upper or concrete-side flange 32, a lower or insulation-side flange 34, and a web 36 connecting flanges 32 and 34. Beams 30 are disposed perpendicular to studs 10 and 12 at the ends of studs 10 and 12, and with their flanges 32 and 34 directed inwardly and enclosing the ends of flanges 20 and 22. Beams 30 have a length equal to the distance between the outer surfaces of studs 10. Webs 36 of beams 30 are slightly wider than webs 24 of studs 10 and 12, to enable beams 30 to enclose the ends of flanges 20 and 22.

Once studs 10 and 12 and beams 30 have been properly positioned on support surface S, the joints between studs 10 and 12 and beams 30 are welded together to provide additional rigidity and strength to the resulting frame 40. Alternatively, other means can be used to join studs 10 and 12 to each other, as will be appreciated by those of skill in the art.

The three studs 10 and 12 and beams 30 define two interior chambers 42 in frame 40, into which insulation panels 50 are placed. The proper alignment of studs 10 and 12 and beams 30 can in fact be determined by positioning insulation panels 50 between studs 10 and 12 and then adjusting the positions of studs 10 and 12 until their webs 24 and 36 lie against the side edges of panels 50. Beams 30 can then be placed at the ends of studs 10 and 12 and welded into place.

Insulation panels 50 preferably are formed of fiberglass or styrofoam, or any other insulating material which is fire-resistant and suitable for construction purposes. Insulation panels 50 are placed at a predetermined height above lower flanges 22, for example by resting them on a wood or metal formpiece F placed on the support surface S. Each formpiece F can be inserted under insulation panels 50 after the first of beams 30 is welded into place, by lifting up insulation panels 50. Formpieces F are shorter than the distance between lower flanges 34 of beams 30, so that they will remain on the support surface S after the completed insulation panels are removed.

Insulation panels 50 are sized in their height and width to provide a finished modular panel of the required dimensions. Insulation panels 50 can be of any desired thickness less than the distance between flanges 20 and 22 of studs 10 and 12 which will permit panels 50 to be elevated above lower flanges 22 but positioned below upper flanges 20. The thickness selected depends upon the desired insulation level for the resulting modular building panel.

Once frame 40 has been constructed, a bulkhead framework B is placed around frame 40. Bulkhead framework B can be constructed of wood boards or metal plates or can be a pre-cast, one-piece plastic, fiberglass, or steel framework or any other conventional framework construction. The interior surfaces of bulkhead framework B are coplanar with the exterior surfaces of outer studs 10 and beams 30, the sides of bulkhead framework B extending above studs 10 and 12 and beams 30 a sufficient height to permit construction of a two-inch concrete layer above insulation panels 50.

Short metal segments such as nails 52, made of steel or other suitable material, can if desired be inserted to extend upwardly from insulation panels 50. Nails 52 help insulation panels 50 adhere to the concrete layer formed above insulation panels 50.

Once bulkhead framework B and insulation panels 50 are in place, a layer of concrete 60 is sprayed or foamed over insulation panels 50 using conventional equipment, completely filling the volume of interior chambers 42 above insulation panels 50 and extending over upper flanges 22 of studs 10 and 12 so that upper flanges 22 are embedded in the concrete layer 60. Preferably, concrete layer 60 comprises a foamed concrete, such as VIN-LOX GAS CONCRETE, manufactured by Vin-Lox Corporation of Florida, which is a mixture including cement, sand, foaming agent, and water; or Cell-u-crete®, which is a mixture including cement, sand, foaming agent, fibrillated polypropylene fibers (for reinforcement), superplasticizer (a dispersing admixture which provides more efficient hydration of cement particles), and water. These foamed concretes can be sprayed monolithically, and reduce the weight of the layer while simultaneously improving its insulation properties. Concrete layer 60 can be textured or embossed in various decorative styles, for example to provide the appearance of brick in the exterior surface of the building.

Once the concrete layer 60 has set, bulkhead framework B is removed, leaving a modular building panel 70.

Modifications and variations of the above-described embodiments of the present invention are possible, as appreciated by those skilled in the art in light of the above teachings. For example, a basic modular building panel 70 can be constructed using only two outer studs 10 and dispensing with the use of one or more inner studs 12. In this case, flanges 20 and 22 of outer studs 10 will face inwardly towards each other, and all other features of the modular building panel 70 and the method of making same will be identical to those described above.

It is therefore to be understood that, within the scope of the appended claims and their equivalents, the invention may be practiced otherwise than as specifically described.

What is claimed is:

1. A structural building panel comprising:

(a) a single, monolithic, planar slab having a thickness and parallel inner and outer surfaces, said slab being formed primarily of cellular concrete unreinforced by conventional metal reinforcement members; and (b) a pair of parallel linear members, each of said linear members having outer and inner opposed parallel edges, a web connecting said edges, and an outer flange at said outer edge extending substantially perpendicular to said web, said slab extending between said webs of said linear members, said outer edges and said outer flanges being embedded in said slab inwardly of said inner surface, and said outer surface of said slab being uninterrupted.

2. The building panel of claim 1, wherein each of said linear members further comprises an inner flange at said inner edge extending substantially perpendicular to said web.

3. The building panel of claim 1, further comprising:

(c) an insulation panel positioned against said inner surface of said slab between said pair of linear members and dimensioned to cover said inner surface of said slab between said pair of linear members.

4. The building panel of claim 3, wherein said insulation panel has an inner surface and an outer surface, said outer surface of said insulation panel facing said inner surface of said slab and said inner surface of said insulation panel being inset from said inner edges of said linear members.

5. The building panel of claim 3, wherein said insulation panel has an inner surface and an outer surface, said outer surface of said insulation panel facing said inner surface of said slab and said outer surface of said insulation panel having projections extending outwardly therefrom, said projections being embedded in said inner surface of said slab.

6. A structural building panel comprising:

(a) a single, monolithic, planar slab having a thickness and parallel inner and outer surfaces, said slab being formed primarily of cellular concrete unreinforced by conventional metal reinforcement members; and (b) a pair of parallel outer side linear members and at least one inner linear member intermediate and parallel to said outer side linear members, each of said linear members having opposed parallel outer and inner edges, a web connecting said edges, and an outer flange at said outer edge extending substantially perpendicular to said web, said slab extending between said webs of said outer side linear members, said outer edges and said outer flanges of said outer side linear members and said at least one inner linear member being embedded in said slab inwardly of said inner surface, at least a part of said web of said at least one inner linear member also being embedded in said slab, said outer surface of said slab being uninterrupted, and said inner surface of said slab being interrupted by said at least one inner linear member extending outwardly thereof.

7. The building panel of claim 6, wherein each of said linear members further comprises an inner flange at said inner edge extending substantially perpendicular to said web.

8. The building panel of claim 6, further comprising:

(c) a plurality of insulation panels, each of said panels being positioned against said inner surface of said slab between a pair of adjacent linear members and dimensioned to cover said inner surface of said slab between said pair of adjacent linear members.

9. The building panel of claim 8, wherein each of said insulation panels has an inner surface and an outer surface, said outer surface of each of said insulation panels facing said inner surface of said slab and said inner surface of each of said insulation panels being inset from said inner edges of said linear members.

10. The building panel of claim 8, wherein each of said insulation panels has an inner surface and an outer surface, said outer surface of each of said insulation panels facing said inner surface of said slab and said outer surface of each of said insulation panels having projections extending outwardly therefrom, said projections being embedded in said inner surface of said slab.

11. A structural building panel comprising:

(a) a single, monolithic, planar slab having a thickness and parallel inner and outer surfaces, said slab being formed primarily of cellular concrete unreinforced by conventional metal reinforcement members; and (b) a pair of parallel linear members, each of said linear members having outer and inner opposed parallel edges, a web connecting said edges, an outer flange at said outer edge extending substantially perpendicular to said web, and an inner flange at said inner edge extending substantially perpendicular to said web, said slab extending between said webs of said linear members, said outer edges and said outer flanges being embedded in said slab inwardly of said inner surface, said inner edges and said inner flanges extending outwardly and being offset from said inner surface of said slab to define a gap between said inner flanges and said inner surface of said slab, and said outer surface of said slab being uninterrupted.

12. The building panel of claim 11, further comprising:

(c) an insulation panel positioned against said inner surface of said slab between said pair of linear members in said gap between said inner flanges and said inner surface of said slab and dimensioned to cover said inner surface of said slab between said pair of linear members.

13. The building panel of claim 12, wherein said insulation panel has an inner surface and an outer surface, said outer surface of said insulation panel facing said inner surface of said slab and said inner surface of said insulation panel being inset from said inner edges of said linear members.

14. The building panel of claim 12, wherein said insulation panel has an inner surface and an outer surface, said outer surface of said insulation panel facing said inner surface of said slab and said outer surface of said insulation panel having projections extending outwardly therefrom, said projections being embedded in said inner surface of said slab.

15. A structural building panel comprising:

(a) a single, monolithic, planar slab having a thickness and parallel inner and outer surfaces, said slab being formed primarily of cellular concrete unreinforced by conventional metal reinforcement members; and (b) a pair of parallel outer side linear members and at least one inner linear member intermediate and parallel to said outer side linear members, each of said linear members having opposed parallel outer and inner edges, a web connecting said edges, and an outer flange at said outer edge extending substantially perpendicular to said web, said slab extending between said webs of said outer side linear members, said outer edges and said outer flanges of said outer side linear members and said at least one inner linear member being embedded in said slab inwardly of said inner surface, at least a part of said web of said at least one inner linear member also being embedded in said slab, said inner edges and said inner flanges of said outer side linear members and said at least one inner linear member extending outwardly and being offset from said inner surface of said slab to define a gab between said inner flanges and said inner surface of said slab, said outer surface of said slab being uninterrupted, and said inner surface of said slab being interrupted by said at least one inner linear member extending outwardly thereof.

16. The building panel of claim 15, further comprising:

(c) a plurality of insulation panels, each of said panels being positioned against said inner surface of said slab between a pair of adjacent linear members in said gap between said inner flanges of said pair of adjacent linear members and inner surface of said slab and dimensioned to cover said inner surface of said slab between said pair of adjacent linear members.

17. The building panel of claim 16, wherein each of said insulation panels has an inner surface and an outer surface, said outer surface of each of said insulation panels facing said inner surfaces of said slab and said inner surface of each of said insulation panels being inset from said inner edges of said linear members.

18. The building panel of claim 16, wherein each of said insulation panels has an inner surface and an outer surface, said outer surface of each of said insulation panels facing said inner surface of said slab and said outer surface of each of said insulation panels having projections extending outwardly therefrom, said projections being embedded in said inner surfaces of said slab.

* * * * *